US005123658A

United States Patent [19]

Elfanbaum

[11] Patent Number: 5,123,658

[45] Date of Patent: Jun. 23, 1992

[54] CARD GAME

[76] Inventor: Shlomo Elfanbaum, P.O. Box 579, Kefar Vitkin 40201, Israel

[21] Appl. No.: 675,828

[22] Filed: Mar. 27, 1991

[30] Foreign Application Priority Data

Mar. 28, 1990 [IL] Israel ..... 093931

[51] Int. Cl.[5] ..... A63F 9/18; G09B 3/00

[52] U.S. Cl. ..... 273/430; 273/459; 434/346

[58] Field of Search ..... 273/430.273.429; 434/346

[56] References Cited

U.S. PATENT DOCUMENTS 3,918,174 11/1975 Miller et al. ..... 434/346
4,466,614 8/1984 Bachman et al. ..... 434/346 X
4,508,513 4/1985 Donovan ..... 434/346
4,964,642 10/1990 Kamille ..... 434/346 X

*Primary Examiner*—William H. Grieb
*Attorney, Agent, or Firm*—Browdy and Neimark

[57] ABSTRACT

The present invention is directed to a card game intended to develop the knowledge and associate skills of the player. The game is made up of a plurality of cards with a first portion having an illustration covered and concealed by a material that can be removed by scratching and a second portion having a plurality of descriptive identifiers one of which has a concealed indicator which identifies it as explaining the illustration on the first portion. The removable material is demarcated into a plurality of smaller areas so that the player removes the concealing material gradually to reveal the illustration. When the player believes he knows what the illustration is, he tries to locate the correct identifier on the second portion of the card by removing the material covering the correct indicator.

7 Claims, 2 Drawing Sheets

CARD GAME

Figure 1:
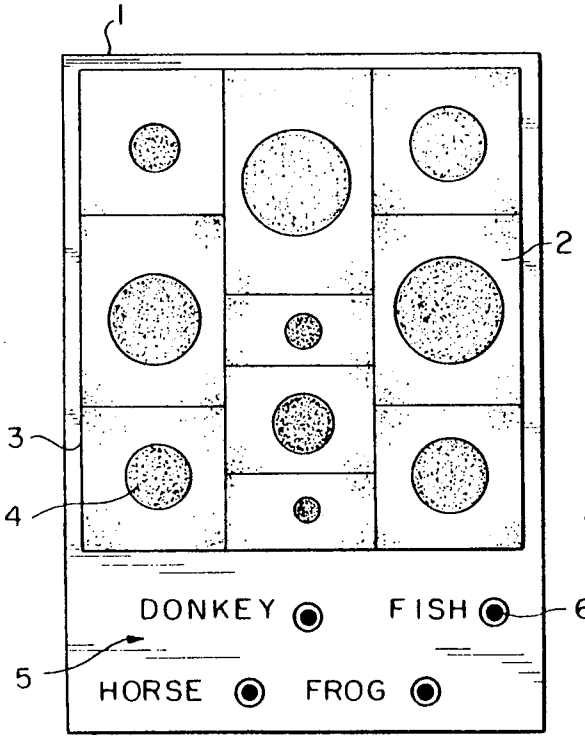

The present invention is designated to serve as a means to develop the associative and learning skills of children and adults, and to broaden the players' knowledge of a range of subjects, such as: languages, geometrical shapes, proverbs and idioms, names of celebrities, the geography of countries, animals, etc.

It is designated to suit all ages, respective of the level of difficulty, and can be played by groups as well as individually.

The invention consists of a method and combination by which the player is to recognize various shapes strictly by their partial and random exposure, and then try to visualize them wholly in his imagination, and link the shapes supposedly recognized with other shapes. The player can then verify his guess on the spot. The extent of the shapes' exposure is determined by the player, and the winner is the player who succeeded in recognizing the shape while least exposing it.

This process, of visualization of the whole shape based on its exposed tip alone, develops the players' imagination and associative power. Moreover, this game is an amusing way by which shapes hitherto unfamiliar to the players are instilled in their consciousness. Children will learn to recognize animals, various alphabets, proverbs, etc. Adults will broaden their knowledge of slang idioms in various languages, of various artistic fields, etc. Practically every subject whatsoever could be conveyed by this card game.

From a didactic point of view, this card game represents a precedent, as it acquaints the players with a wide range of subjects by means of scratchable cards. The game is based on the recognition of linkage between two various shapes or sentences, such as: a picture and a proverb, a symbol and a picture, a geographical map and an area's verbal definition, an illustration and a picture, a shape and its verbal definition. This is accomplished by means of illustrations, drawings, symbols and/or sentences, all of which are concealed by a scratchable material, while the same cards feature also uncovered shapes or sentences, (which are not concealed by the scratchable material).

The items mentioned, are either entirely or partially concealed by a scratchable material. The concealed area is divided into several sections or squares. Each section is a potential point to be scored along the game. The borders between the sections disappear as the scratching proceeds, since the players are required to expose an ever growing part of the concealed item in order to discover its linkage with one of the uncovered items on the lower part of the card.

A marking concealed by a scratchable material features beside the uncovered item. The one placed beside the correct item, that is, the one beside the item corresponding to the concealed upper part of the card, differs in color or shape from the other markings featuring on the same card.

The object of the game is to recognize a linkage between a concealed item and one of the uncovered items, while exposing by scratching the least possible part of the concealed item, and thereby, remain with the largest number of unscratched squares. Each unscratched square is worth a point. The recognition is gradual process which allows for the players to score points respective of their individual perception, knowledge and understanding.

To demonstrate our point, following are the game's instructions:

SCRATCH A SQUARE

The game consists of 16 cards. 4 sets of 4 of a kind. Each card features a picture covered by scratchable squares, and below it four idioms or expressions, each of which is accompanied by a scratchable square. One of these identify with the covered picture.

THE PURPOSE OF THE GAME

To accumulate as many points as possible.

HOW?

By identifying the covered picture while scratching the least possible number of squares. That is, to be left with the highest possible number of points. Each unscratched square is worth one point.

INSTRUCTIONS

1. Each player receives one card from the face up deck.
2. Each player, in turn, scratches one square in his own card, while the others are watching him.
3. player who thinks he can identify the picture on his card, and wishes to risk a guess, yells loudly: SCRATCH And to the eyes of all the players he scratches the square beside the expression he thinks is correctly identifies the picture.
4. If the uncovered square is EMPTY-the player's guess proves CORRECT, and he keeps the card. But if the uncovered circle is BLACK-the player returns the card to the bottom of the deck. (This gives an advantage to another player who will take this card later during the game) In both cases, he draws a new card from the deck.
5. The game goes on until all cards have been taken.

THE WINNER IS

The player whose total of unscratched squares is the highest.

For demonstration purposes, following is a description of some of the illustrations featuring on the cards:

FIG. 1: The card (1) is entirely covered by a scratchable material (2), and is divided into sections by lines (3) and circles (4). Four different answers feature in the lower part of the card (5). Adjacent to each answer is a marking (6) the one beside the correct answer differing from the others in shape or color.

Figure 2:
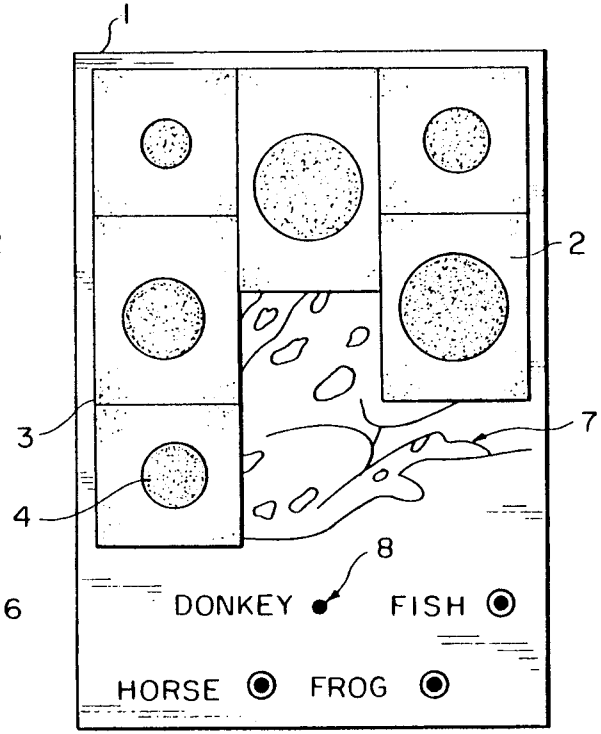

FIG. 2: The card (1) has been partially scratched, thereby revealing part of the concealed illustration (7). An attempt to make a guess has also been made, by scratching the marking, and the guess turned out to be wrong.

Figure 3:
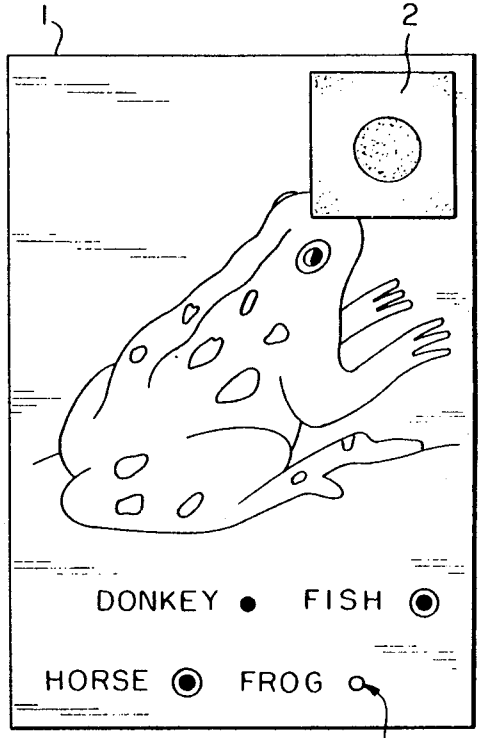

FIG. 3: Same card has been further scratched and the concealed item further exposed. The correct answer (9) has been located. This card has scored the player on a single point.

Figure 4:
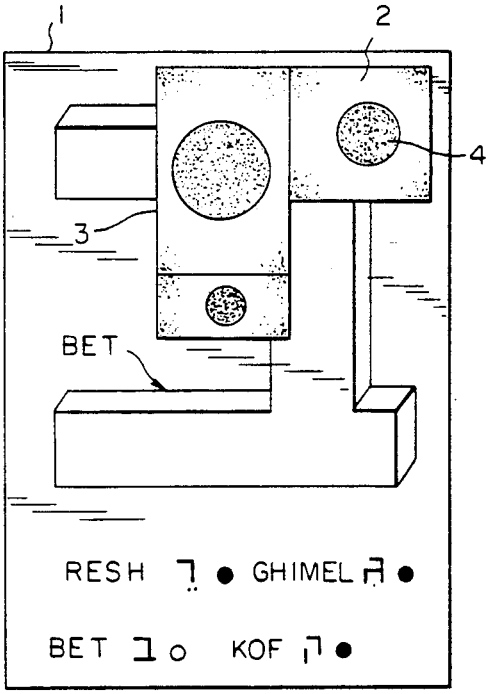

FIG. 4: This card features a letter of the Hebrew alphabet, to be recognized by the players.

Figure 5:
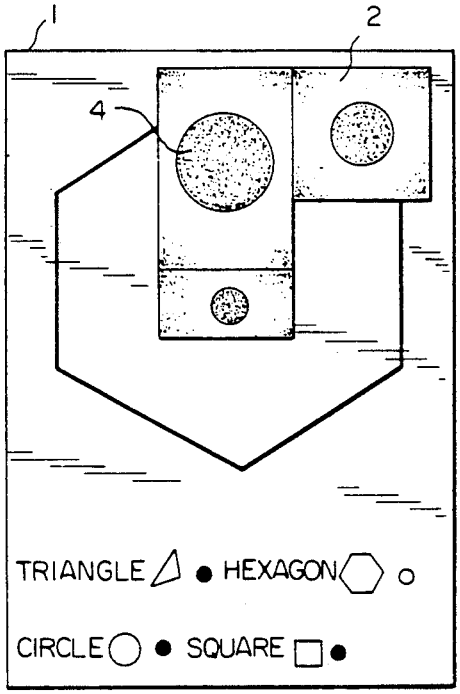

FIG. 5: This card features a geometrical shape, to be recognized by the players.

Figure 6:
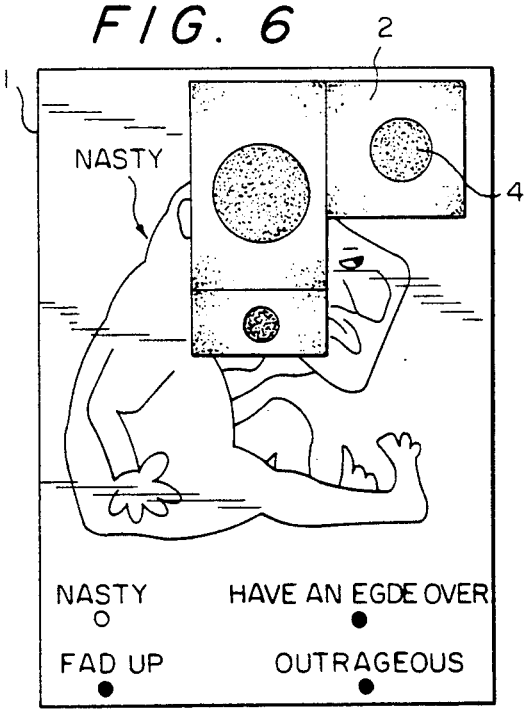

FIG. 6: This card features an illustration corresponding to one of the four slang idioms on the bottom part of the card.

Figure 7:
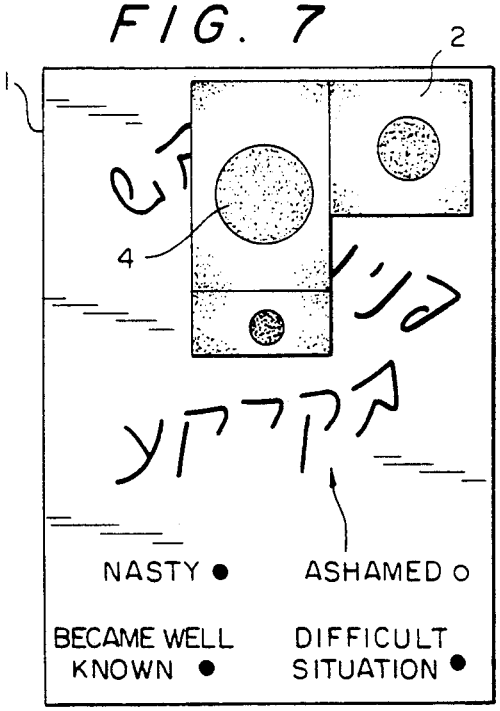

FIG. 7: This card features a proverb corresponding to one of the paraphrases in the bottom part of the card.

I claim:

1. A card game designed to enhance the general knowledge and associative ability of a player, said game comprising, a plurality of cards, an first area and a second area on a face of each of said cards, said first area having an identifiable illustration, said first area covered by a first removable scratchable material concealing said identifiable illustration, said first removable scratchable material on said upper area being demarcated into a plurality of smaller areas, said second area having a plurality of descriptive identifiers, one of said plurality of descriptive identifiers explaining said identifiable illustration concealed by said first removable scratchable material, indicators located next to each of said plurality of descriptive identifiers, one indicator of said indicators located next to said one of said plurality of descriptive identifiers explaining said identifiable illustration being different than from all remaining said plurality of descriptive identifiers, a second removable scratchable material covering and concealing said indicators, wherein, said player can remove said first removable scratchable material from one of said plurality of smaller areas during said player turn to reveal a portion of said identifiable illustration and selectively remove said second removable scratchable material from one of any of said plurality of descriptive identifiers to locate said one of said plurality of descriptive identifiers explaining said identifiable illustration.

2. The card game of claim 1 wherein, said identifiable illustration is a picture of an animal.

3. The card game of claim 1 wherein, said identifiable illustration is a geometric shape.

4. The card game of claim 1 wherein, said identifiable illustration is a letter of an alphabet.

5. The card game of claim 1 wherein, said identifiable illustration is a proverb.

6. The card game of claim 1, wherein said game comprises sixteen cards.

7. The card game of claim 6, wherein said game comprises four sets of four cards, each of said four sets having a different identifiable illustration and a different plurality of descriptive identifiers including one of said plurality of descriptive identifiers explaining said different identifiable illustration.

* * * * *